US006082843A

United States Patent [19]

Somogyi et al.

[11] Patent Number: 6,082,843

[45] Date of Patent: Jul. 4, 2000

[54] SUPPORTING FRAMEWORK AND KIT FOR CONSTRUCTING HOUSE FURNITURE

[76] Inventors: Tibor Somogyi, Kisfaludy u. 17/a, H-2111 Szada; Mária Óryné Sal, Körösfói u. 4., H-2100 Gödöllő ; István Szatura, Gödöllói u. 49, H-1141 Budapest, all of Hungary

[21] Appl. No.: 09/142,259

[22] PCT Filed: Mar. 21, 1996

[86] PCT No.: PCT/HU96/00014

§ 371 Date: Sep. 18, 1998

§ 102(e) Date: Sep. 18, 1998

[87] PCT Pub. No.: WO97/34514

PCT Pub. Date: Sep. 25, 1997

[30] Foreign Application Priority Data

Apr. 29, 1994 [HU] Hungary ..... 9401231

[51] Int. Cl.[7] ..... A47B 47/00

[52] U.S. Cl. ..... 312/265.3; 312/265.1; 312/109

[58] Field of Search ..... 312/109, 257.1, 312/265.3, 265.1

[56] References Cited

U.S. PATENT DOCUMENTS

| | | | |
|---|---|---|---|
| 845,829 | 3/1907 | Tacke | 312/109 X |
| 1,788,883 | 1/1931 | Madsen | 312/257.1 X |
| 3,285,684 | 11/1966 | Duncan | 312/265.3 |
| 3,948,581 | 4/1976 | Helman et al. | 312/257.1 X |
| 4,265,502 | 5/1981 | Blodee et al. | 312/109 |
| 4,768,845 | 9/1988 | Yeh | 312/257.1 |
| 4,817,538 | 4/1989 | Michaelsen . | |
| 5,253,853 | 10/1993 | Herron, III . | |

FOREIGN PATENT DOCUMENTS

| | | | |
|---|---|---|---|
| 2492643 | 10/1980 | France . | |
| 2509593 | 7/1981 | France . | |
| 2635256 | 2/1990 | France | 312/257.1 |
| 380970 | 9/1923 | Germany | 312/257.1 |
| 2114992 | 12/1971 | Germany | 312/257.1 |
| 24 28 976 | 1/1976 | Germany . | |
| 3148504 | 7/1983 | Germany | 312/257.1 |
| 36 16 732 | 11/1987 | Germany . | |
| 182592 | 4/1986 | Hungary . | |
| 369779 | 3/1932 | United Kingdom | 312/109 |
| 0609547 | 10/1948 | United Kingdom | 312/257.1 |

*Primary Examiner*—Peter M. Cuomo
*Assistant Examiner*—David E. Allred
*Attorney, Agent, or Firm*—Arent Fox Kintner Plotkin & Kahn, PLLC

[57] ABSTRACT

The invention concerns a supporting framework, in particular for house furniture, the framework taking the form of a rectangular grid structure consisting of load-bearing vertical supports and horizontal adjustable panels (4) inserted between the supports. Preferably, the furniture constructed from the kit also comprises adjustable units which are provided with movable door and/or window elements (5) and are accessible from the front, the back of the units generally being closed by a rear panel which covers the entire area and, as well as providing greater protection from dust also increases rigidity at the corners of the furniture. The supporting framework comprises ladder-like supports, which consist of at least two—or in the case of furniture with a graduated cross-sectional shape generally of three—prefabricated vertical uprights (10) extending parallel at a spacing from each other. The supports also consist of intermediate members (11) which interconnect these uprights (10) in a manner such that a spacing is determined therebetween. The uprights (10) have recesses which are provided in rows at a predetermined separating spacing (E) from one another and are used to hold in a positioned and load-bearing manner preferably cross-bars (2, 2', 2") which are likewise made from pre-fabricated extruded profiled sections and cut to size. In cross-section, these recesses can preferably be dove-tailed transverse grooves (16), sawtooth-shaped cut-outs producing horizontal support surfaces or bores accommodating carrier bolts projecting in a bracket-like manner.

13 Claims, 3 Drawing Sheets

Fig.1
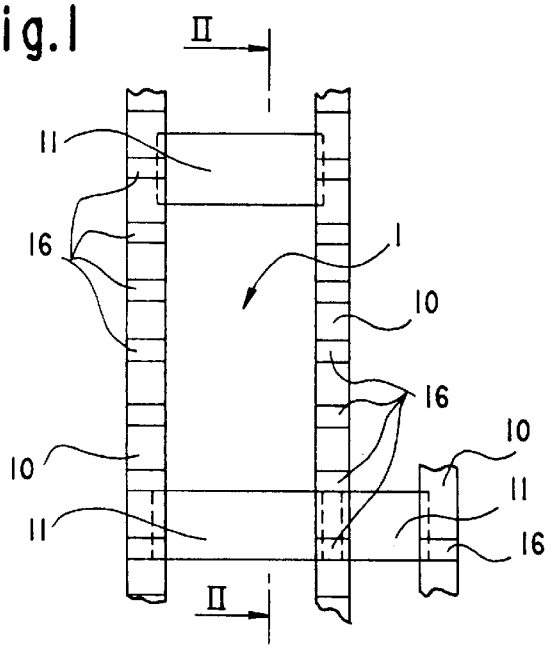
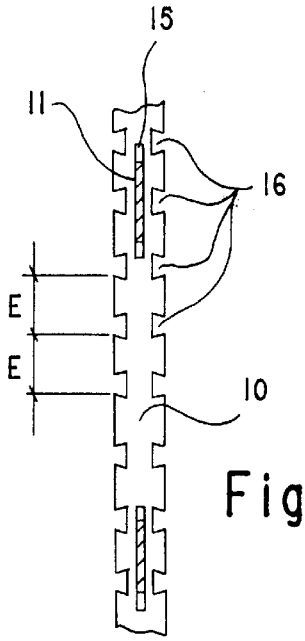
Fig.2
Fig.3
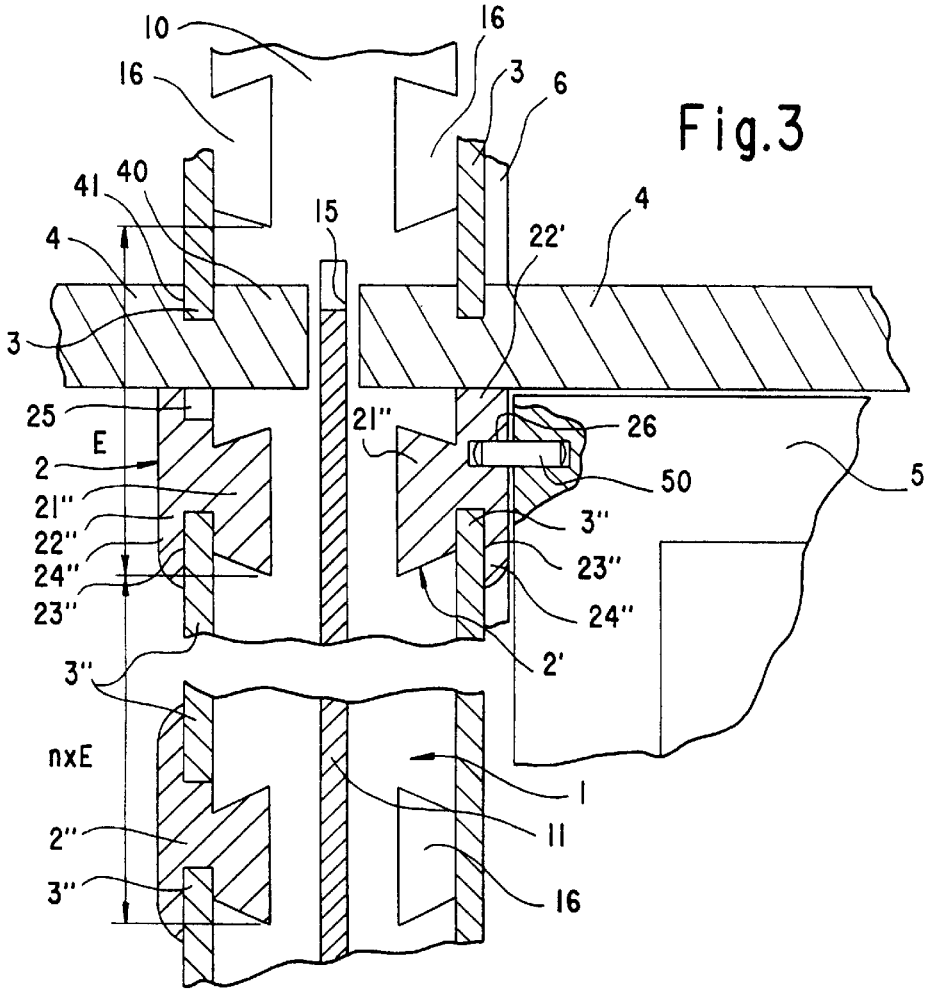

Fig.4
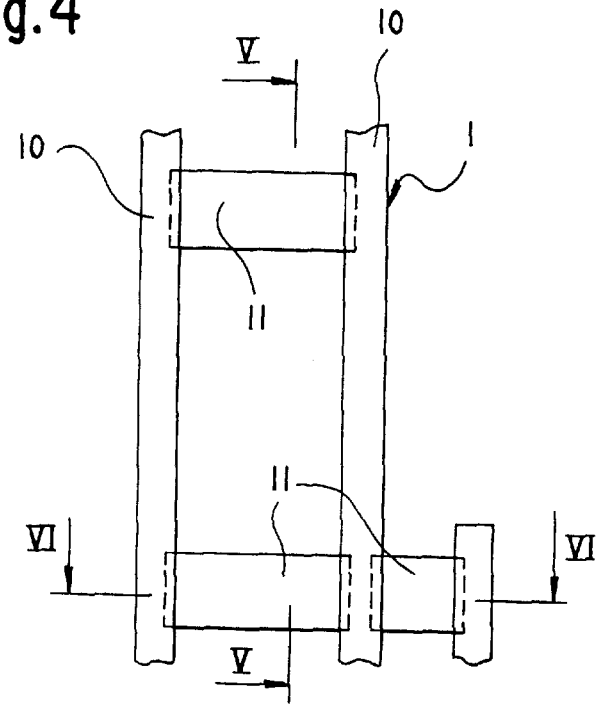
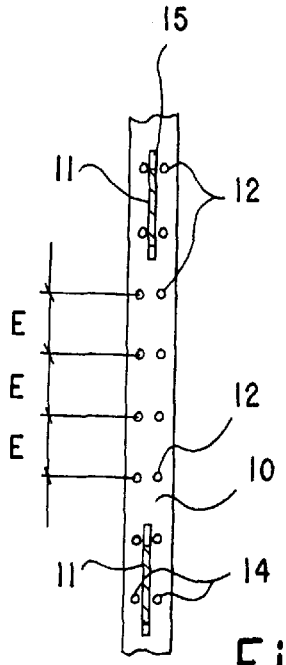
Fig.5
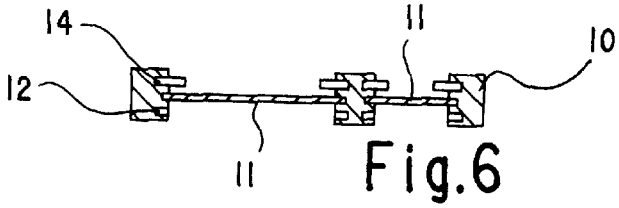
Fig.6
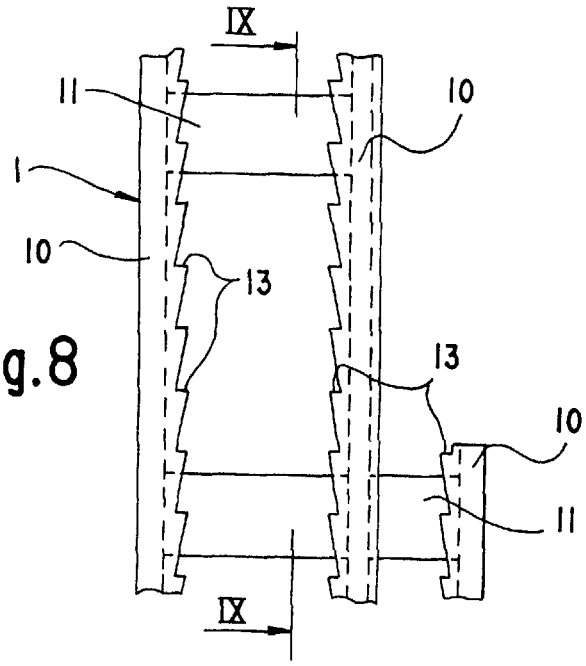
Fig.8
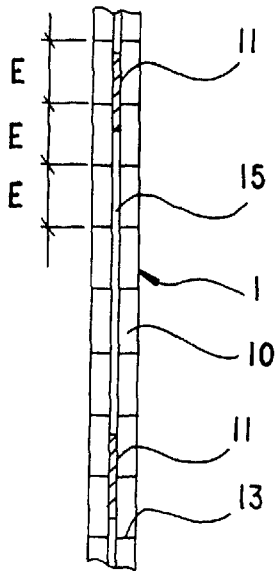
Fig.9

SUPPORTING FRAMEWORK AND KIT FOR CONSTRUCTING HOUSE FURNITURE

TECHNICAL FIELD

The invention concerns to kit furniture, especially house furniture. The subject of the invention is a framework and a set of elements including the components of the framework, which enable the creation of different and varied designs of house furniture. The invention allows for the batch factory production of a wide assortment of furniture and furniture sets, through the use of pre-fabricated and stored (off-the-shelf) furniture elements, at low expenses—requiring at the most, the cutting of various pre-fab kit elements to length and the installation activities to be carried out on site. The framework of the kit furniture embodying the invention, especially house furniture, consists of load-bearing vertical supports and horizontal adjustable panels inserted between these supports, taking the shape of a rectangular grid structure. In most of the embodiments, the assembled furniture also comprises at least partly movable door and/or window elements from the front. The furniture mostly consist of panel units, and the back of the units is generally being closed by a rear panel which covers the entire area and, as well as providing greater protection from dust, also increases rigidity at the corners of the furniture.

BACKGROUND ART

Furniture and furniture sets—partly called as kit furniture and having the characteristics described in the introduction—have been known and available from trade for a long time.

It is generally characteristic of the known approaches that for the load bearing and appropriately rigid connection of supports and panel elements, various hardware is always used, flushed into different single-purpose recesses, which are covered with additional plastic elements—frequently of the snap-on type after assembly—so that the recesses would not deteriorate the aesthetic appearance of the furniture. In order to increase the position and spacing options of panel elements and so as to modify the spacing between panels, the mostly vertical supports of various well known kit furniture approaches are designed with a pre-fabricated line of bores, and for the positioning and load-bearing support of panel elements, metal or plastic pins fitted into the appropriate bores of the line of bores at the required positions are applied. Related to the design of rectangular grid structure furniture and furniture sets assembled with joining panel elements located next to and above each other, numerous solutions have already become known. As examples, among others DE-OS 36 16 732 A1 and HU PS 182 592 can be mentioned.

It is a joint characteristic and a resulting joint disadvantage of the approaches described and mentioned above that the so assembled furniture and furniture sets characteristically retain their "kit furniture" nature. For example the pre-fabricated lines of bores remain visible on a prolonged basis, along with the supporting pins and the connection hardware or their covering. Such a furniture is less and less attractive nowadays to an increasing number of highly demanding customers. In the meantime, however, due to the high prices, very few customers may afford to buy tailor-made or small batch, so-called solid wood and period" furniture produced by the small-scale industry. Accordingly, a so far uncovered market gap is involved, represented by the fact that the supply of the furniture market is unable to fully satisfy the requirements of a highly demanding clientele, as a result of lacking technical solutions.

The purpose of the invention is the development of such a pre-fabricated framework and set of modules, which is identical with the well known assembled kit furniture solutions in that it is designed and set up using the modules and units of a pre-fabricated set of elements, and also in that primarily the final assembly takes place at the site identified by the customer, but regarding external appearance, quality and life cycle, this type of furniture is a proper match for tailor-made or small batch so-called solid wooden and/or period furniture produced by the small scale industry.

DISCLOSURE OF INVENTION

The objective identified is accomplished by designing and applying a framework and a set of elements consisting of pre-fabricated modules. The new and decisive characteristic representing the essence of the invention is that the supporting framework comprises ladder-like supports which consist of at least two—or in the case of furniture with a graduated cross sectional shape, generally of three—pre-fabricated vertical uprights extending parallel at a spacing from each other.

The supports also consist of intermediate members which interconnect these uprights in a manner such that a spacing is determined therebetween. The uprights have recesses which are provided in rows at a pre-determined separating spacing from one another used to hold in a positioned and load bearing manner preferably cross-bars which are likewise made from pre-fabricated extruded profile sections and cut to size. In cross-section these recesses can preferably be dove-tailed transverse grooves or sawtooth-shaped cut-outs producing horizontal support surfaces or bores accommodating carrier bolts projecting in a bracket like manner.

The set of elements embodying the invention also include—in addition to the cross-bars, various shape and size panel elements, thin panel-like covering sidewall and rearwall elements—crown and decorating bars, especially glazed tilting and sliding doors, hinged glazed and full doors, pre-fabricated drawers and furthermore in certain cases feet and other particular covering and/or decorating additional elements.

The preferred and appropriate embodiments of the framework and set of elements embodying the invention are such structural solutions, when the cross-bars holding the pre-fabricated uprights of the framework are thin, preferably 4 mm thick especially plywood or fibreboards arranged with a spacing not larger than 60 cm preferably, which boards are clamped in a matched way with flushed grooves in the opposite surfaces of solid wood uprights.

For production and assembly, an extremely advantageous implementation is insured by the design of such grooves embodying the invention, where the facing surfaces of the vertical uprights of the framework are designed as bracket-type structural elements supporting the cross-bars in a positioned and load-bearing manner, as supports of the framework, on the parallel sides of the uprights, already during the pre-fabrication process, in the form of horizontal transverse grooves flushed at a spacing corresponding to the determined unit distance. During the implementation processes, it has proven to be extremely favourable that the horizontal transverse groove notched on the sides of the uprights has preferably a trapezoid or rather dove-tail cross-section, the shape and size of which provide at least a limited shaped contact between the supports and the cross-bars in a way that the cross section is identical with that of the latter. The cross-bars included in the set of elements are produced preferably of a hard wood, especially beech and its cross section and size, respectively, are identical with the shape and size cross section of the horizontal transverse groove flushed into the sides of the uprights, and with the cross-section of an external range of sections protruding laterally from the plane of a support in the framework. In the extreme cross sectional areas, a longitudinal notch is made on the bottom plane of cross-bars—running longitudinally—and aligned with the plane of the modules on the inner side of the cross-bars.

By virtue of a possible alternative approach, the facing surfaces of the vertical uprights of the framework serve as bracket-like structural elements that support the cross-bars in a positioned and load-bearing manner, which surfaces are suitable for the matched receiving of pins protruding from the mentioned surfaces, at a spacing corresponding to the defined unit spacing, preferably between 60 and 70 mm and especially 64 mm, using a row of bores consisting of bores pre-made in the uprights during prefabrication.

In a different approach, the facing surfaces of the uprights in the framework can be designed as bracket-like structural elements supporting the cross-bars in a positioned and load-bearing manner, as sawtooth surfaces having horizontal surface elements arranged at spacings corresponding to the identified unit distance.

In the case of the two approaches described above, the cross-bars representing the elements of the kit consist of hard wood, especially beech parts and fitted already during the prefabrication process with pre-drilled holes especially for countersunk head fixing screws that can be secured to the flats of vertical uprights. The shape of the cross section comprises such an internal cross section which consists of the internal shaped cross section cross-bar, the corner cut-outs receiving the vertical uprights, and sometimes an intermediate section which enables this internal shaped cross section to protrude between the supports of the framework, in the course of which there is a bottom groove in the external section range protruding in a lateral direction from the flat plane of the support, in a longitudinal direction, which receives in a matched way the upper edge of a side plate representing a further element of the kit, which groove has an inner side surface aligned with the flat plane of the support.

According to one of the measures aimed at the multi-purpose use of the elements of the kit embodying the invention, on the bottom side of the cross-bars there is at least one covering edge with an internal side surface aligned with the external side surface of the bottom groove, and having as appropriate an arched etching on the external surface.

According to measures aimed at expanding the choice of furniture that can be designed through the use of framework and kit embodying the invention, at least certain pre-fabricated cross-bars of the kit have—in a continuous external range of sections protruding from the flat plane of the support—side surfaces aligned with the side surfaces of the bottom groove, notched from the top and a side groove running also in the total length and confined by the clamping top groove of the sidewall proceeding in a longitudinal direction and/or having parallel side surfaces with a spacing to the top cross-bar surface, which is suitable for guiding the pin of tilting-sliding doors representing other elements of the kit.

Such embodiments of the framework and kit featuring in the invention have proven to be advantageous and well useable in practice where the panel elements of the kit are fitted especially with pre-drilled bores for the screws serving for fixing to the cross-bars and in the given case with edges protruding into the spaces between the supports of ladder-like supports. In certain top surfaces, especially those of the so-called bottom and intermediate panel elements, a groove having an external side surface aligned with the flat plane of the support in the direction of depth, which groove is suitable for the matched clamping of the bottom edges of sidewall panels representing elements of the kit is notched.

We would like to note here that in the case of framework where dove-tail shaped transverse grooves are notched into the vertical uprights as support elements, it is not necessary to use fixing by additional screws at the cross-bars and vertical supports. By virtue of another simplification, the panels may also be constructed without parts protruding into the section between the vertical uprights of the framework, i.e. they can be simple oblong elements.

By virtue of an important element of the invention, the highly demanding and attractive aesthetic appearance of furniture assured by using the framework and the pre-fabricated modules of the kit is improved by the fact that the surfaces visible in the assembled condition of the furniture are supplied especially with cherry or cherry-look colour and design veneering or a different suitable surface finish. At the same time the production expenses and manufacturing costs are significantly reduced by the fact that the structural elements of the vertical support of the framework and the elements of the kit have surfaces invisible in the assembled condition of the furniture and they are in principle left unprocessed and they can be in the given case fitted with fungicide and/or flame-retarding surface treatment in the course of pre-manufacturing.

From the framework embodying the invention and the as much as possible pre-manufactured elements of the kit, a highly demanding appearance furniture corresponding to the objectives and creating the impression of tailor-made "small scale industry" monolithic, solid wood furniture, thereby sought and accepted by the more demanding customers and users, while maintaining all the advantages resulting from the standardisation and pre-manufacturing of installed module furniture can be provided. If the elements are pre-manufactured in large batches with the appropriate tools, this requires valuable, excellent quality, high output and precision machines. The prefabrication of elements in a large batch with the appropriate tools, and keeping them on store in an unassembled condition requiring a relatively small warehousing volume and only a limited installation input requirement on site while the designer's freedom is largely retained, result in a significant shortening of the production and delivery time from the receiving of the order until the order is met, and furthermore a reduction of costs as well. The vertical uprights of the framework have the appropriate load bearing capacity, and at the same time ensure a material saving. The various elements can be delivered to the customer easily and without the risk of damage. From the wide range of pre-manufactured elements of the kit, a varied range of furniture from the aspect of function, appearance and use, which can be adapted fully and simply to the local endowments, and which furniture are of a high standard and of a nice appearance can be created.

BRIEF DESCRIPTION OF DRAWINGS

The essence of the invention is also depicted through advisable and advantageous implementation examples below, by means of the attached drawing, in details. In the drawing are FIG. 1 the vertical support of the framework embodying the invention in a sketch showing in side view an emphasised detail of the implementation as a first example, FIG. 2 a longitudinal sketch taken along plane II—II shown in FIG. 1 regarding the support used as an example, FIG. 3 a sketch of a longitudinal section of a furniture, which depicts the vertical support of the framework shown in FIGS. 1 and 2, FIG. 4 a sketch showing the side view of an emphasised section of a vertical support as another example, FIG. 5 a longitudinal section of the support design, taken along plane V—V shown in FIG. 4, FIG. 6 the sketch of a cross section of a furniture which depicts the section along plane VI—VI of FIG. 4 regarding the vertical support of the framework shown in FIGS. 4 and 5, FIG. 7 a cross section of a furniture used as an example, which depicts the vertical support of the framework embodying the invention and shown in FIGS 4 and 6, FIG. 8 an implementation longitudinal section sketch of a third example which depicts the vertical support of the framework embodying the invention, and FIG. 9 a longitudinal section of a vertical support of the frame structure embodying the invention, along planes IX—IX of FIG. 8.

MODES OF CARRYING OUT THE INVENTION

Figure 7:
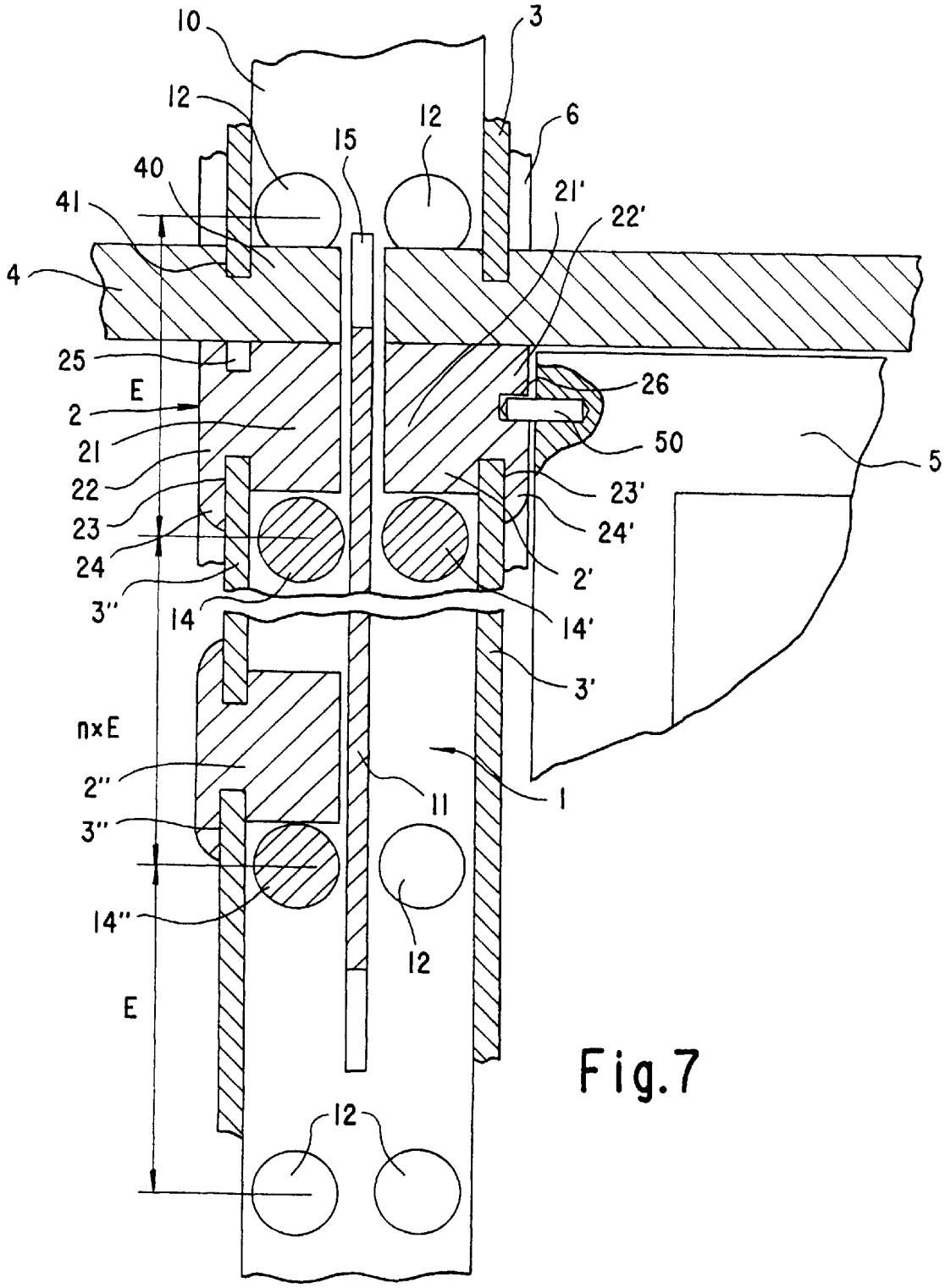

FIGS. 1 and 2 of the attached drawing depict the longitudinal side view and horizontal section of an implementation example of the vertical support (1) of the framework of a furniture constructed according to the invention. It is well shown by the figures that the support (1)—through intermediate members (11) representing new and decisive characteristics of the invention—is designed as a ladder-like structural unit clamped in parallel with spaces defining a stepped cross section in the case of the given example, and containing three vertical uprights in the larger depth bottom section of the furniture. Already in the production plant, during the batch-type manufacturing procedure, the support elements (10) are fitted with dove-tail shaped cross section groove (16) at predetermined spacings (E). These are the transverse grooves (16) which become invisible after assembling the furniture, because they will be covered by the supports. With the cross-bars (2") shown in FIG. 3, they serve for positioning and load-bearing. The intermediate members (11) interconnecting the elements (10) of pre-fabricated uprights (1) are thin, especially 4 mm thick boards, especially fibreboards arranged in vertical spacings advisably not exceeding 60 cm, which boards are clamped in a matched way in grooves (15) notched into the facing surfaces of solid wood uprights (10). In the case of the implementation shown in FIGS. 1 and 2, the grooves (15) only have a length covering the interconnection ranges of crossbars (11) extended with the run-out length of the production tool. However, it is possible without any problem to notch a continuous groove (15) into the uprights (10) as shown in FIG. 9.

FIG. 3 of the attached drawing shows a longitudinal section, with the application of the framework embodying the invention, about the example part of the furniture assembled at the customer in a way that it includes vertical uprights (1) shown in FIGS. 1 and 2. The figure is to be interpreted as if a section has been cut out of the furniture in a longitudinal direction from the rear panel view. It is well shown by the diagram that a surface of one part of the framework upright (10)—which is invisible from the front of the furniture and therefore left in its original condition—with the support groove (15) of the cross-bar (11) shown in the section has been notched. In addition, the dove-tail shaped grooves (15) in spacings corresponding to a predetermined unit distance (E) on the surfaces of the upright (10) are also visible, and into these grooves at pre-specified points cross-bars (2, 2', 2") made of preferably hard wood, especially beech are flushed and these cross-bars are part of the set of elements embodying the invention. In this way, the cross-bars (2, 2', 2") are fixed in a positioned and load-bearing way in the transverse grooves (16). In the course of this process it is not necessary to secure the cross-bars (2, 2', 2") by screws to the upright (10).

The cross sectional shape of each cross-bar (2, 2', and 2") is determined by the transverse groove (16) and internal section range (21) of identical cross sectional shape and size notched from the side (10) of uprights, and the continuous external section range (22', 22") protruding in a lateral direction from the side plane of uprights (10). In the external range of sections (22', 22") on the bottom of each cross-bar (2, 2', and 2") there is a groove running continuously in the longitudinal direction with a bottom groove (23") with an inner side surface aligned with the plane and clamped in a matched way to the uprights (10). On the grooved (23") bottom side of the cross-bar (2, 2', 2") there is a cover edge (24) protruding downwards, and having an internal side surface aligned with the external side surface of the bottom groove (23") and having an arched cover edge (24) on its external surface, through which the exposed longitudinal edges of the sidewalls (3") are pressed against the sides of uprights (10) without any other securing. There are also cross-bars (2") associated with the kit embodying the invention, which have two identical cover edges (24). One of these is visible in the bottom part of the cross-bar (2") and the other at the top part. By means of such cross-bars (2"), the edges of two neighbouring sidewalls (3") can be covered and secured to the uprights (10) of the framework.

Certain prefabricated crossbars (2', 2") associated with the kit have an upper groove (25) interconnecting the unused sidewall (3) in the given case, notched from the top running in a longitudinal direction and having sidewalls aligned with the sidewalls of the bottom groove (23) falling into a continuous external range of sections (22) protruding from the plane of the framework uprights (10). A further cross-bar (2') associated with the kit is fitted with a side groove (26) continuously running and restricted by side surfaces, parallel with the spacing of a top bar surface, which groove ensures the introduction of a pin (50) and enables the fitting of movable door and/or window elements (5) representing another significant element of the kit. Such doors and windows (5) (of the Lingel type) could be useful even in the case of book-shelves in order to provide improved protection against dust, because they can be opened up along a horizontal plane and pushed back. In this way a simple access to books and other objects on the book-shelf is possible. Since these doors and windows (5) are generally glazed, even in the closed position of doors and windows (5) the books and other objects on the shelves are well visible.

FIG. 3 showing the details of the invention depict also two panel elements (4). In the given case, they can be secured by screws to the cross-bars (2, 2') by means of a line of bores (not shown in the Figure). In the course of implementation depicted in the drawing, panel elements (4) fitted with edges (40) on two sides are shown. In such cases, panel elements (4) should have corner cut-outs receiving the vertical uprights (10). They enable the edges (40) of panel elements (4) to protrude into the space between the supports (1) and the uprights (10). In practice, it has been proven, however, that the edges (40) are not necessary in the way that the panel elements (4) are simple oblong shaped shelves without any edge (40) and corner cut-out. The top surface of the panel element (4) shown in the figure, especially the so-called bottom and medium panels, have in the upper surface along the edge (40) an interconnecting groove (41) running along both directions, and having an external side surface aligned with the flat plane of the neighbouring support (1) of the upright (10) and clamping the bottom edge of the side wall (3) representing elements of the framework.

Each of the cross-bars shown (2, 2', 2") is suitable for receiving the ball type or cylindrical pins available from trade, by means of which the furniture may also be fitted with drawer elements representing part of the kit embodying the invention (which drawer elements are not shown in the figures). Further parts of the kit are represented by the surface treated rear panels (again not shown) especially on one side—which means on the side which is visible from the outside—which rear panels comprise relatively thin panel elements, and the crown edge and decorating bars (6) and the already mentioned tiltable glazed doors and windows (5) and solid and glazed doors, pre-fabricated drawers, and sometimes footing and accessories serving especially for covering and/or decoration. If the set of elements embodying the invention are aimed to be used also in manufacturing "period" furniture, the construction elements must be expanded with characteristic features, while the framework embodying the invention and the assembly principles can be used unchanged.

FIGS. 4 to 6 depict the vertical side view and the horizontal as well as vertical sections of a detail of one support (1) of the framework embodying the invention. It is well depicted that the positioned and load-bearing grooves of cross-bars (not shown) are fitted with two parallel lines of bores (12) pre-fabricated at spacings corresponding to the identified unit distance (E) with bracket-like carrier pins (14) in the uprights at spacings of 64 mm. On the facing surfaces of uprights (10), the bores (12) are again not visible in finish-assembled furniture, because they are located on the inner sides of the uprights.

FIG. 7 shows a vertical section, where similarly to FIG. 3 the detail of such a furniture is shown, which depicts the vertical support (1) of the framework element shown in FIGS. 4 and 6. It is well depicted that in this implementation the cross-bars (2, 2', 2") are supported by carrier pins (14, 14', 14") protruding into the internal range of sections (21, 21') of the uprights (10). In the course of this process, all the cross-bars (2, 2', 2") of the kit embodying the invention must be pressed against the side surfaces of uprights (10) by horizontally tightened screws (not shown in the Figure). For these bolts, the bores are prepared already in the pre-manufacturing process. The inner range of sections (21) of the cross-bars (2, 2', and 2") must be fitted with corner cut-outs and if necessary also with a middle cut-out in order to connect the vertical upright (10) which enables that the carrier pins (14, 14', 14") protrude into an appropriate depth in the framework between the inner section (21, 21') of the cross-bars (2, 2', and 2") and the uprights (10). Otherwise the design and function of cross-bars are identical with the detailed description in relation to FIG. 3.

And finally, FIGS. 8 and 9 show such vertical sections about the possible third implementation of the vertical support (1) of the framework embodying the invention, in the case of which the positioning and load-bearing grooves of the cross-bars shown here are worked into the facing surfaces of uprights (10) of the support of the framework embodying the invention. The grooves are established on the sawtooth type support surfaces (13) arranged at a distance corresponding to the identified unit spacing (E). These support surface elements always perform the same functions as the pins (14) depicted in FIGS. 4 and 6. The interconnections between the horizontal support elements (13) and the cross-bars (2, 2', and 2") used in the framework described are so much identical that beyond the detailed description in FIGS. 3 and 7, an expert does not need any more extensive explanations.

From the pre-fabricated elements of the framework and kit embodying the invention, highly demanding, good quality and long life furniture and furniture sets can be provided, and by on-site assembly, furniture of the size and design matched to the requirements of the customer can be created. The furniture can be easily adjusted to local endowments. The furniture to be implemented could vary between wide limits also in length and height, and as a result of the range of panel elements, they may also include corner units. The dimensions of furniture to be installed can be varied in three dimensions. Further versions and implementations deviating in certain details from the description above can be implemented regarding the framework and kit embodying the invention, and they can be further developed without prejudice to the following claims.

| | |
|---|---|
| support | 1 |
| upright | 10 |
| intermediate member | 11b |
| bore | 12 |
| sufface element | 13 |
| pin | 14, 14', 14" |
| groove | 15 |
| transverse groove | 16 |
| cross-bar | 2, 2', 2" |
| internal range of sections | 21, 21', 21" |
| external range of sections | 22, 22', 22" |
| bottom groove | 23, 23', 23" |
| covering edge | 24, 24', 24" |
| top groove | 25 |
| bottom groove | 26 |
| side wall | 3, 3', 3" |
| panel element | 4 |
| edge (flange) | 40 |
| groove | 41 |
| door | 5 |
| pin | 50 |
| decoratingbar | 6 |
| unit distance | E |

What is claimed is:

1. Assembled house furniture having a rectangular grid structure, the house furniture being assembled from a kit of pre-fabricated component parts including rear walls, and crown and decorating bars, the kit optionally including at least one of glazed tilting-sliding doors having mounting pins, hinged glazed and/or solid doors having hinges, and prefabricated drawers, the kit comprising:

a plurality of load bearing vertical supports, each of said supports including at least two parallel vertical uprights and at least a pair of intermediate members, said intermediate members interconnect said vertical uprights such that a spacing is determined therebetween;

a plurality of either one of supporting surfaces and grooves spaced along said vertical supports a predetermined unit distance along a longitudinal axis of said vertical uprights;

a plurality of load bearing cross-bars cut to size from prefabricated pieces of profiled wood, said supporting surfaces and grooves shaped to engage said load bearing cross-bars;

a plurality of adjustable horizontal panels inserted between said vertical supports, said load bearing cross-bars support, at predetermined positions said horizontal panels; and a pair of least two thin board side wall elements fixedly held by said load bearing cross-bars such that all components of said vertical supports are hidden by the assembled house furniture, wherein said load bearing cross-bars slidably support the mounting pins of the glazed tilting-sliding doors, and fixedly hold the hinges of the hinged glazed and/or solid doors.

2. The assembled house furniture according to claim 1, wherein said supporting surfaces and grooves of said vertical uprights are sawtooth surface and dove-tail shaped, respectively, when viewed in cross-section, and said load bearing cross-bars each have a cross-sectional area that can engage either one of said supporting surfaces and grooves of said vertical supports in a load bearing manner.

3. The assembled house furniture according to claim 1, wherein said grooves are transverse and notched from facing surfaces of said vertical uprights of said vertical supports along said vertical supports at intervals of said predetermined unit distance, wherein said transverse grooves serve as positioned load bearing structural elements of said load bearing cross-bars.

4. The assembled house furniture according to claim 3, wherein the transverse grooves are horizontal and are notched into side walls of said vertical uprights, a section of said transverse grooves is dove-tail shaped and configured to nest with an internal section range of said load bearing cross-bars in order to ensure that said vertical supports and said load bearing cross-bars are interconnected.

5. The assembled house furniture according to claim 3, wherein said load bearing cross bars are made of wood, and have a cross section shape that corresponds to a shape and size of said transverse grooves notched into a side wall of said vertical uprights and forming an internal section range and an external section range protruding from side walls of said vertical supports, wherein the external section range has a bottom groove in an inner side surface that is aligned with a plane of said vertical uprights and runs along a longitudinal direction of a bottom side of said cross-bars.

6. The assembled house furniture according to claim 5, wherein said load bearing cross-bars have a cover edge formed as an arch and protruding downwards such that an internal side surface of said cover edge meets an external side surface of said bottom groove.

7. The assembled house furniture according to claim 5, wherein said load bearing cross-bars have a groove in said external section range to guide said pin of said tilting-sliding doors.

8. The assembled house furniture according to claim 1, wherein facing surfaces of said vertical uprights are fitted as a structural element to hold said load bearing cross-bars in a positioned and load bearing way and are provided with a line of bores adapted to receive matched bracket pins that protrude from said facing surfaces, wherein said line of bores are drilled into said vertical uprights at spacings between 60 and 70 mm, corresponding to said predetermined unit distance.

9. The assembled house furniture according to claim 8, wherein said load bearing cross-bars are horizontal, said load bearing cross-bars having an external section range that protrudes laterally from a vertical plane of said vertical supports, said load bearing cross-bars being made of wood and having a shaped cross section, said external section range having a bottom groove running along a bottom surface in a longitudinal direction relative to said longitudinal axis of said cross-bars, said external section range receives a top edge of a side wall having an internal side surface aligned with a vertical plane of said vertical supports.

10. The assembled house furniture according to claim 1, wherein facing surfaces of said vertical uprights have toothed surfaces as a structural element to support in a positioned and load bearing way said load bearing cross bars with said supporting surfaces at spacings corresponding to said predetermined unit distance.

11. The assembled house furniture according to claim 1, wherein each of said adjustable horizontal panels have edges protruding into a space section between said vertical uprights and a notched groove in a top surface of each of said edges of said horizontal panels, said notched grooves being suitable to clamp bottom edges of said thin board side wall elements to form a side wall.

12. Framework and set of elements set forth in claim 1, characterized in that surfaces visible in the assembled condition of the furniture are supplied with a suitable surface treatment.

13. The assembled house furniture according to claim 1, wherein a surface of said vertical supports is not exposed when the furniture is in an assembled condition and is one of either unprocessed and surface treated with fungicide and/or flame retarding agents.

* * * * *